US005873317A

United States Patent [19]

Komuro et al.

[11] Patent Number: 5,873,317

[45] Date of Patent: Feb. 23, 1999

[54] SEWING SYSTEM HAVING A DATA REGISTERING DEVICE

[75] Inventors: Kyoji Komuro; Xiao Ming Zheng, both of Nagoya, Japan

[73] Assignee: Brother Kogyo Kabushiki Kaisha, Nagoya, Japan

[21] Appl. No.: 45,717

[22] Filed: Mar. 23, 1998

[30] Foreign Application Priority Data

Mar. 28, 1997 [JP] Japan ..... 9-095091
Sep. 25, 1997 [JP] Japan ..... 9-279948

[51] Int. Cl.[6] ..... D05B 19/00

[52] U.S. Cl. ..... 172/470.04; 112/155; 112/445; 364/470.09

[58] Field of Search ..... 112/470.01, 470.04, 112/470.06, 102.5, 445, 458, 155; 364/470.09

[56] References Cited

U.S. PATENT DOCUMENTS 5,253,599 10/1993 Hashiride ..... 112/445 X
5,657,708 8/1997 Okuno et al. ..... 112/470.04 X

FOREIGN PATENT DOCUMENTS 5-76670 3/1993 Japan .

*Primary Examiner*—Peter Nerbun
*Attorney, Agent, or Firm*—Oliff & Berridge, PLC

[57] ABSTRACT

Disclosed is a sewing system including a plurality of sewing machines and a controlling device which is electrically connected with the plurality of sewing machines for transmitting control commands to the plurality of sewing machines. The controlling device includes a memory device which stores identification data for identifying each of the plurality of sewing machines, a data registering device, which is used for registering arbitrarily registered data in relation to the identification data stored in the memory device for identifying each of the plurality of sewing machines, and a displaying device having a display screen. The controlling device displays the arbitrarily registered data on the display screen for identifying each of the plurality of sewing machines, and the control commands are transmitted to sewing machines identified by the arbitrarily registered data displayed by the displaying device.

20 Claims, 14 Drawing Sheets

13b

| ID NUMBER | NAME |
|---|---|
| SM1 | TARO |
| SM2 | KEN |
| SM3 | ——— |
| SM4 | ——— |

TB

| ID NUMBER | POWER |
|---|---|
| SM1 | ON |
| SM2 | ON |
| SM3 | ON |
| SM4 | ON |

13b

| ID NUMBER | COLOR |
|---|---|
| SM1 | RED |
| SM2 | GREEN |
| SM3 | —— |
| SM4 | —— |

SEWING SYSTEM HAVING A DATA REGISTERING DEVICE

BACKGROUND OF THE INVENTION

The present invention relates to a sewing system such as an embroidering system having a plurality of sewing machines and a host computer for controlling the plurality of sewing machines.

Recently, in factories for sewn products, a sewing system (e.g., an embroidering system) in which a plurality of sewing machines (e.g., embroidering machines) are controlled by a single host computer has been employed. In such a sewing system, the host computer is electrically connected to the plurality of sewing machines, and identifies each sewing machine and transmits various control commands to each of the plurality of sewing machines to create sewn products.

For example, U.S. Pat. No. 5,313,896 discloses an embroidering system which is provided with a host controller connected with control units of a plurality of embroidering machines. The host controller is provided with a display device, an input device, and a control device. The control device stores image data and embroidery data corresponding to a plurality of embroidery patterns. A display screen of the display device is divided into a predetermined number of display areas on which the plurality of embroidery patterns are displayed. The plurality of embroidery patterns displayed on the plurality of the display areas are transmitted to a plurality of embroidering machines, respectively.

In the above-described conventional embroidering system, the host controller assigns identification numbers such as EM1, EM2, . . . , to the plurality of embroidering machines, and stores the assigned numbers for identifying each embroidering machine. When, for example, embroidery patterns to be embroidered by four embroidering machines, EM1, EM2, EM3 and EM4, are displayed on the display device, the identification numbers are also displayed.

Although the conventional embroidering system displays the identification numbers for a plurality of embroidering machines as described above, it was impossible to register names of the embroidering or sewing machines and display the same.

Sometimes, the operators of the sewing system (e.g., the embroidering system) assign a name to each embroidering machine, and call each sewing machine by the assigned name such as TOM, or the like. Even in such a case, the sewing system identifies each sewing machine only by the identification number, and accordingly it is sometimes difficult for the operators to relate the identification numbers to the assigned names. In a worse case, the operators may relate a wrong identification number to a certain name mistakenly, and refer to a wrong sewing machine.

It is unfavorable if a control command is transmitted from the host controller to a wrong sewing machine in view of safety in the facility since the sewing machine may malfunction, and further, quality of products may become worse. On the other hand, when a sewing system is newly installed in the sewn products factory, the sewing machines may not be assigned with names intrinsic to respective sewing machines. In such a case, in order to identify each sewing machine, the identification number should be assigned to each sewing machine.

SUMMARY OF THE INVENTION

It is an object of the invention to provide a sewing system (e.g., an embroidering system) in which each of sewing machines connected to a host controller can be identified easily and accurately.

For the above object, according to the invention, there is provided a sewing system including a plurality of sewing machines and a controlling device which is electrically connected with the plurality of sewing machines for transmitting control commands to the plurality of sewing machines, the controlling device including: a memory device which stores identification data for identifying each of the plurality of sewing machines; a data registering device, which is used for registering arbitrarily registered data in relation to the identification data stored in the memory device for identifying each of the plurality of sewing machines; and a displaying device having a display screen. The controlling device displays the arbitrarily registered data on the display screen for identifying each of the plurality of sewing machines, and the control commands are transmitted to sewing machines identified by the arbitrarily registered data displayed by the displaying device.

According to the sewing system above, desired names, colors or the like can be assigned to the sewing machines, and the assigned names, colors or the like are stored in relation to the corresponding ID numbers in the memory. The names can be displayed on the display, and accordingly, the assigned names, colors or the like enable the operators to identify each sewing machine easily. Therefore, it becomes possible to prevent the operators from erroneously identifying a wrong sewing machine, which prevents inferior products from being produced and improves rate of operation of the sewing system.

Preferably, the memory device can store the arbitrarily registered data.

Optionally, the identification data for identifying each of the plurality of sewing machines may be transmitted from each of the plurality of sewing machines, and stored in the memory device.

Optionally, the data registering device may have a data input device through which the arbitrarily registered data is input.

Further, the arbitrarily registered data may include names of the plurality of sewing machines, the names being intrinsic to the plurality of sewing machines, respectively.

Alternatively or optionally, the arbitrarily registered data may include colors of the plurality of sewing machines, the colors being intrinsic to the plurality of sewing machines, respectively.

Further optionally, the data registering device may include: a display controller which displays the identification data, and the arbitrarily registered data in relation to the identification data; and a data inputting device, which is manually operated to input data to be registered as the arbitrarily registered data, the data input by the data inputting device being stored in the memory device, relationship between the identification data and the arbitrarily registered data being maintained in the memory device.

In this case, the data inputting device is used for registering new data and/or changing the registered data.

Still optionally, the controlling device may comprise an operation condition detecting device, which detects operation condition of each of the plurality of sewing machines, and wherein the controlling device defines a plurality of displaying areas on the display screen, a total number of the plurality of displaying areas being equal to a total number of the plurality of sewing machines which are detected, by the operation condition detecting device, to be operative.

In this case, the controlling device may assign each of the plurality of sewing machines to each of the plurality of displaying areas according to a predetermined order, the displaying areas respectively having arbitrarily registered data displaying areas, the arbitrarily registered data being displayed in the arbitrarily registered data displaying areas, respectively.

Further, the identification data may be displayed in the arbitrarily registered data displaying areas for sewing machines to which the arbitrarily registered data has not been registered.

It is preferable that the arbitrarily registered data includes names intrinsic to the plurality of sewing machines or colors intrinsic to the plurality of sewing machines.

In this case, the colors intrinsic to the plurality of sewing machines are displayed in the plurality of displaying areas, respectively.

Further optionally, the controlling device may further include a mouse pointer for pointing an arbitrary point on the display screen, and control the displaying device to display the mark when a predetermined area of the plurality of displaying areas is indicated by the mouse pointer.

According to another aspect of the invention, there is provided a memory medium which stores a program executed by a controller of a sewing system, the sewing system including a plurality of sewing machines electrically connected to the controller, the program including steps of: storing identification data for identifying each of the plurality of sewing machines in a memory device; registering arbitrarily registered data in relation to the identification data stored in the memory device for identifying each of the plurality of sewing machines; displaying the arbitrarily registered data on a display screen for identifying each of the plurality of sewing machines; and transmitting control commands to sewing machines identified by the arbitrarily registered data displayed at the displaying step.

Optionally, the program may further include a step of detecting operation condition of each of the plurality of sewing machines, and the displaying step includes a step of defining a plurality of displaying areas on the display screen. It is preferable that a total number of the plurality of displaying areas is equal to a total number of the plurality of sewing machines which are detected, at the detecting step, to be operative.

BRIEF DESCRIPTION OF THE DRAWINGS

FIG. 7 is an example of a table indicating embroidering machines which are turned ON;

FIG. 8 shows an example of a screen image of a display device displaying a plurality of areas corresponding to a plurality of embroidering machines;

DETAILED DESCRIPTION OF THE PREFERRED EMBODIMENTS

In the following description, an embroidering system will be described with reference to a first and a second embodiments of the invention.

The embroidering system includes a personal computer and four embroidering machines which are connected to the personal computer. The embroidering machines receive embroidery data transmitted by the personal computer, and perform embroidering operation on work cloth which is held on cloth holding frames, in accordance with the received embroidery data.

Figure 1:
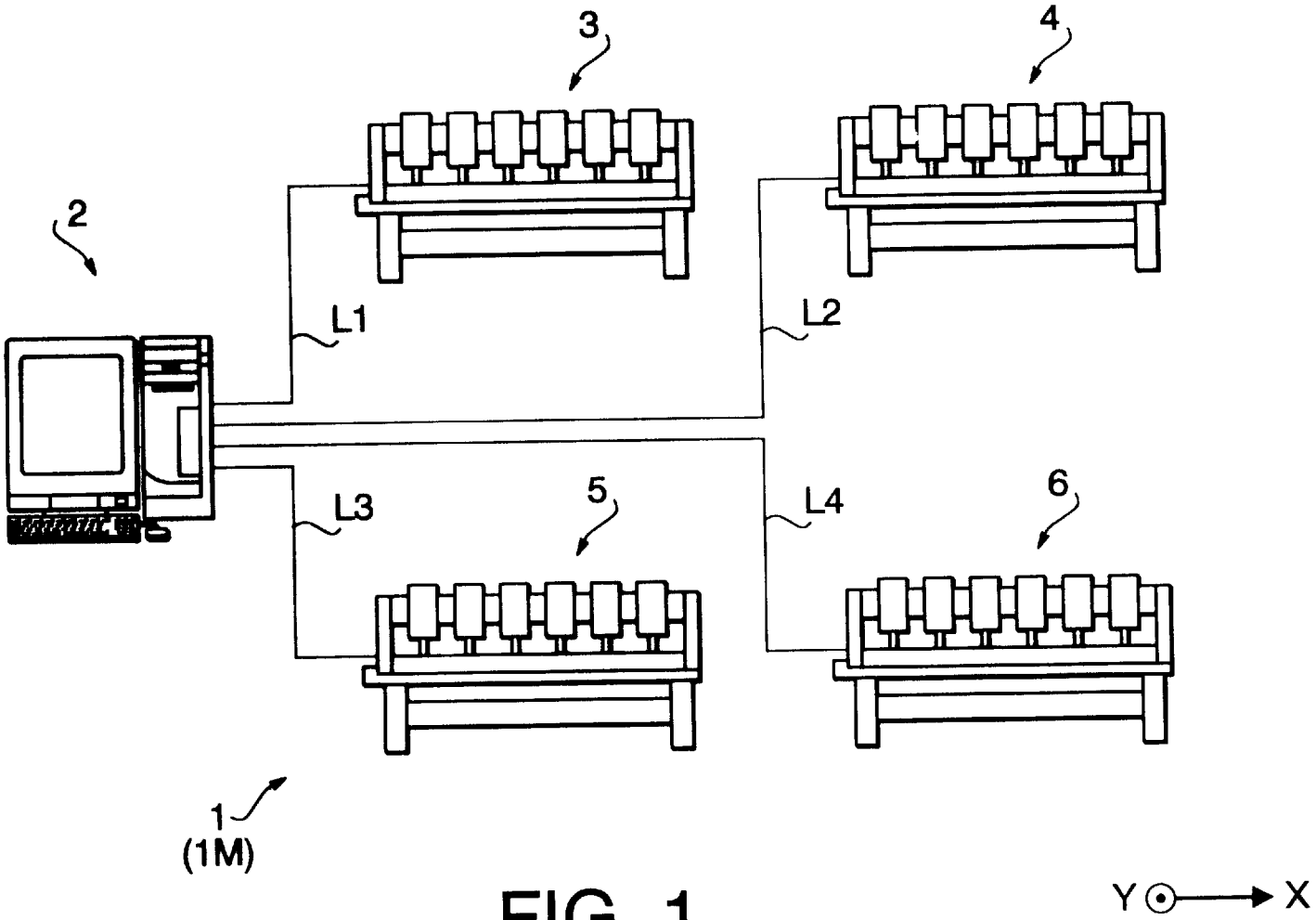
FIG. 1 shows a schematic configuration of an embroidering system according to an embodiment of the invention.

FIG. 1 shows the embroidering system 1 embodying the present invention. The embroidering system 1 includes a personal computer 2, and four embroidering machines 3, 4, 5 and 6 connected to the personal computer 2 through connection lines L1, L2, L3 and L4, respectively. Each of the embroidering machines 3 through 6 is a six-head embroidering machine including six sewing heads. The six sewing heads can be driven simultaneously, and form the same embroidery pattern on the work cloth held by cloth holding frames (not shown).

Figure 2:
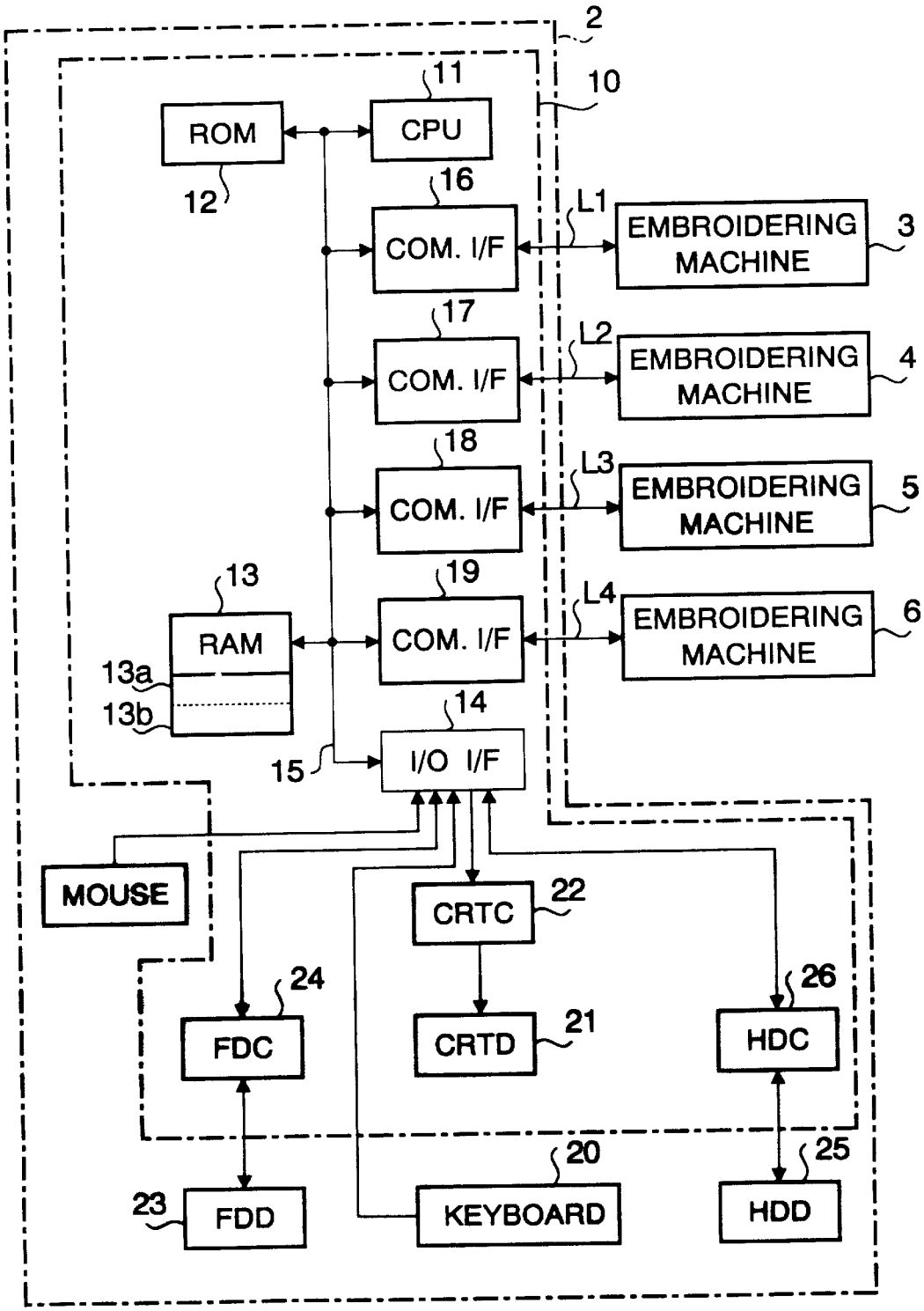
FIG. 2 is a block diagram of a control system of a personal computer employed in the embroidering system shown in FIG. 1.

FIG. 2 shows a block diagram illustrating a control system of the personal computer 2 The personal computer 2 includes:

- a host controller 10 which is provided with a CPU (Central Processing Unit) 11;
- a ROM (Read Only Memory) 12 and a RAM (Random Access Memory) 13 which are connected to the CPU 11 through a bus 15;
- an I/O (input/output) interface 14;
- communication interfaces (communication I/F) 16 through 19 through which the CPU 11 is connected to the first through fourth embroidery machines 3, 4, 5 and 6, respectively;
- a CRT (Cathode Ray Tube) display 21 which is connected to the I/O interface 14;
- a CRT controller 22 which outputs display data to the CRT display 21;
- a floppy disk drive (FDD) 23;
- a floppy disk controller (FDC) 24;

a hard disk drive (HDD) 25; and a hard disk controller (HDC) 26.

Each of the communication I/F 16 through 19 contains, for example, a Centronics interface or an RS-232C interface, and data can be transmitted in both directions.

Further, to the I/O interface 14, a keyboard 20 for inputting letters, characters, and symbols, and a mouse (or another pointing device) 27 are connected.

In the ROM 12, a start-up program to be executed by the CPU 11 when the personal computer 2 is switched ON is stored.

In the hard disk of the hard disk drive (HDD) 25, an operating system such as MS-DOS, Windows or the like is stored. Further, a communication control program for exchanging data with external terminal devices (i.e., the embroidering machines 3, 4, 5 and 6), and various other application programs such as a word processor program, an image processing program and the like are stored. Programs for executing for a DISPLAY CONTROL PROCEDURE, and a NAME REGISTRATION PROCEDURE, which will be described in detail, are also stored in the hard disk.

Figures 3, 4:
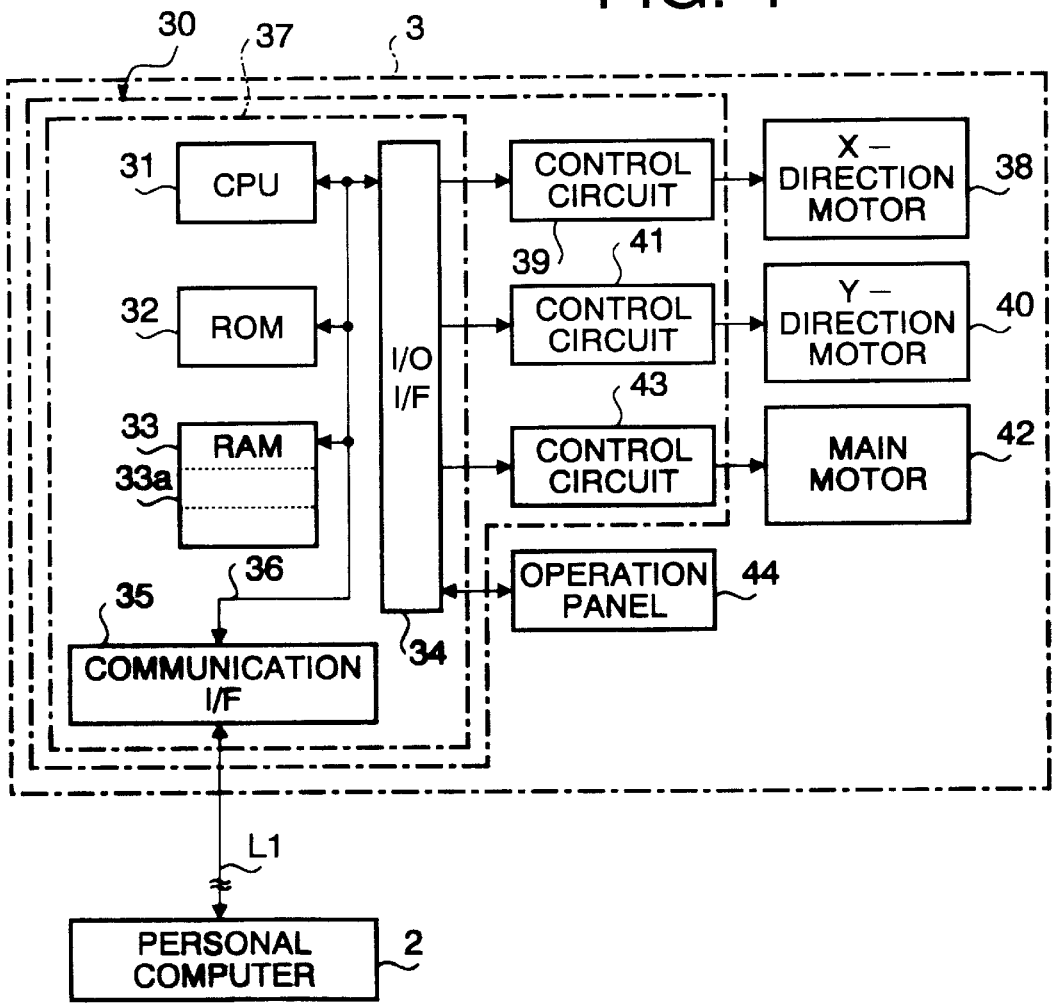
FIG. 3 is a table showing embroidering machine data stored in a second data memory area.
FIG. 4 is a block diagram of a control system of an embroidering machine.

In the RAM 13, a first data memory area 13*a* for storing various data such as embroidery data to be transmitted, a second data memory area 13*b* for storing data tables are provided. In the second data memory area 13*b*, as shown in FIG. 3, table indicating ID (identification) numbers intrinsic to the embroidering machines 3–6, which have been transmitted from the respective embroidering machines to the personal computer 2, and names registered in relation to the ID numbers and intrinsic to the respective embroidering machines are stored. The second data memory area 13*b* is battery backed-up, and the data stored therein is held even if the power switch of the control device is turned OFF.

The control devices of the first to fourth embroidering machines have the similar configurations, and therefore, only one of the control devices will be described. In the description below, the control device 30 of the first embroidering machine 3 will be described with reference to FIG. 4.

The control device 30 includes a CPU 31, a ROM 32 which is connected to the CPU 31 through a bus 36, a RAM 33, an I/O interface 34, a communication I/F 35 which is connected to the personal computer 2 through the line L1, and the like.

The I/O interface 34 is connected with:

an X-direction motor 38 for driving the work frame in an X direction (i.e., a right/left direction in FIG. 1);

a control circuit 39 for controlling movement of the X-direction motor 38;

a Y-direction motor 40 for driving the work frame in a Y direction (i.e., a forward/rearward direction in FIG. 1);

a control circuit 41 for controlling movement of the Y-direction motor 40;

and a main motor 42 for driving the six sewing heads;

a control circuit 43 for controlling movement of the main motor 42; and an operation panel 44 on which a small-size display, indication lamps, various switches are provided.

The ROM 32 stores, in addition to the communication control program, control programs for driving the motors 38, 40 and 42 in accordance with the received embroidery data are stored.

In the RAM 33, a data memory area 33*a* for storing the received embroidery data, work areas for temporarily storing data used when embroidery is carried out are provided.

In the ROM 32 of a control unit 37, embroidering machine identifying numbers SMn (n equals 1 through 4) assigned to each of embroidering machines 3, 4, 5 and 6 are stored. In this embodiment, ID (identification) Nos. "SM1", "SM2", "SM3" and "SM4" are assigned to the embroidering machines 3, 4, 5 and 6, respectively. The control unit 37 of each of the embroidering machines 3, 4, 5 and 6 transmits the ID numbers when it receives an "ID number request" command from the personal computer 2.

Figure 5:
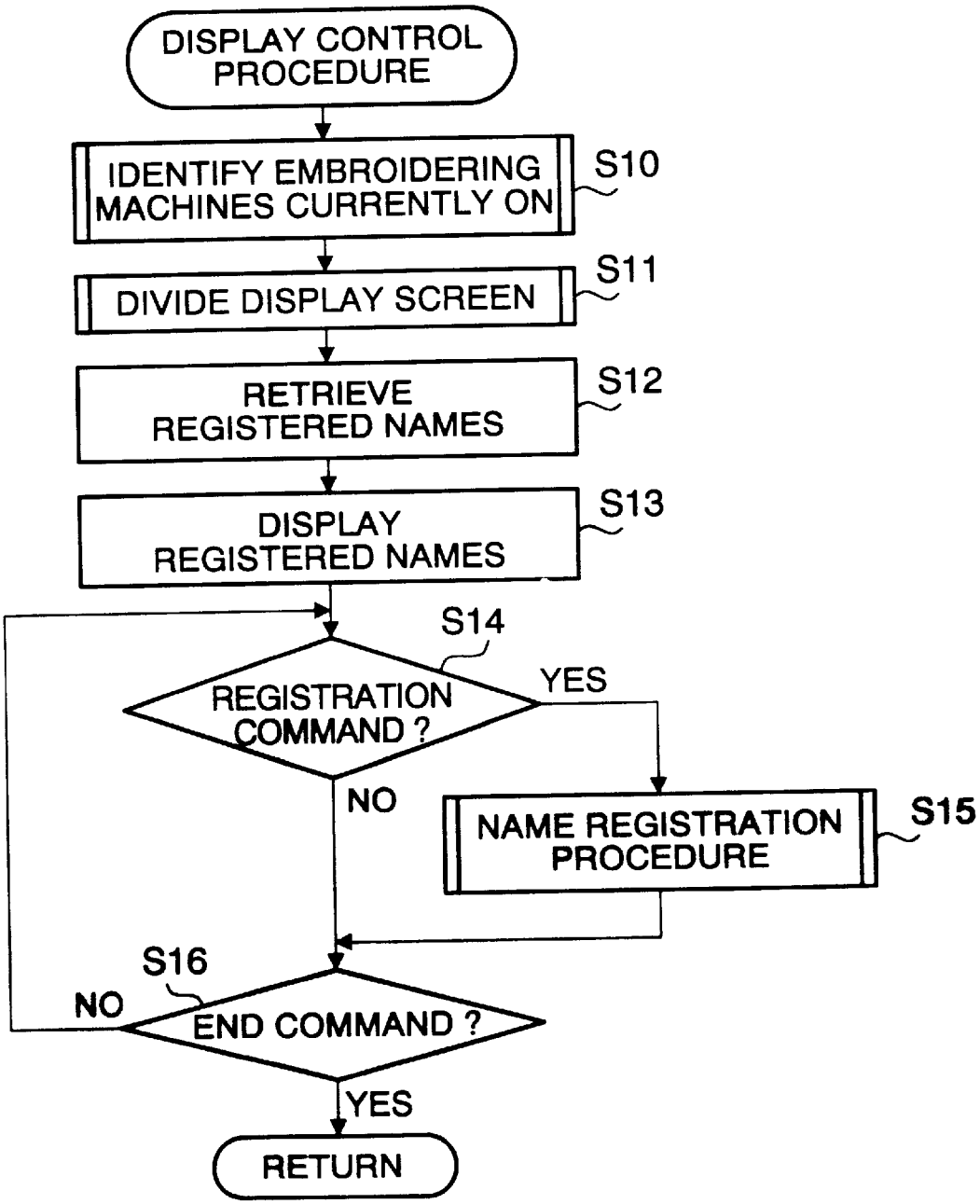
FIG. 5 shows a flowchart illustrating a DISPLAY CONTROL PROCEDURE.

Next, a DISPLAY CONTROL PROCEDURE will be described with reference to a flowchart shown in FIG. 5.

The DISPLAY CONTROL PROCEDURE is executed by the host controller 10 of the personal computer 2. The procedure is initiated when an operator inputs a sewing condition display command through the keyboard 20 of the personal computer 2.

At S10, the host controller 10 identifies the embroidering machines currently turned ON. Specifically, the host controller 10 transmits the sewing condition display command to each of the embroidering machines 3, 4, 5 and 6. Then, based on the ID numbers transmitted from the embroidering machines 3, 4, 5 and 6, the host controller 10 creates a table TB shown in FIG. 7 in a work area of the RAM 13. The table TB indicates whether each of the embroidering machines 3, 4, 5 and 6 is currently powered ON or OFF.

Then, at S11, the screen of the CRT display 21 is divided into a plurality of display areas, the number of the display areas being the number of the embroidering machines currently powered ON, and thus operative.

Figures 7, 8:
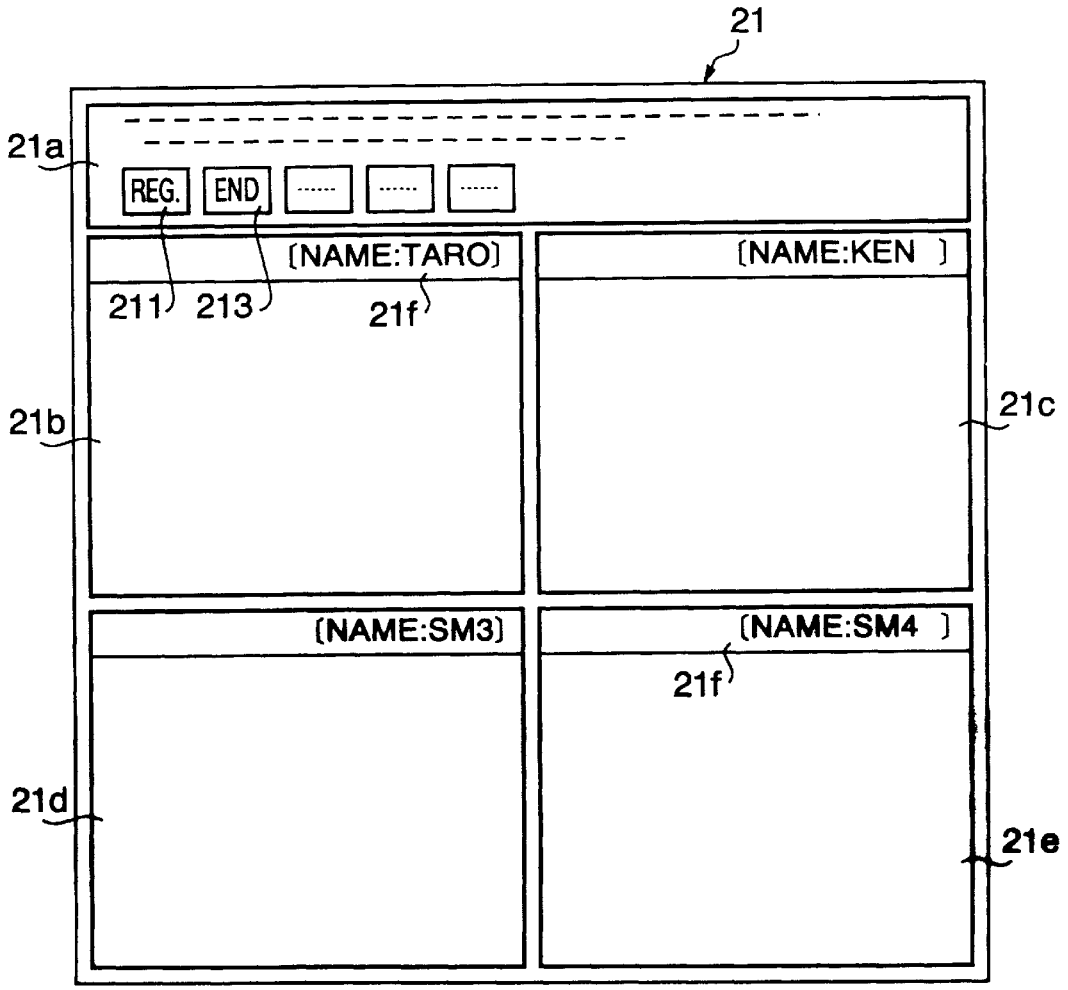

If, for example, all of the embroidering machines 3, 4, 5 and 6 are powered ON as shown in FIG. 7, the display screen of the CRT display 13 is divided into one common area 21*a* and four areas 21*b*, 21*c*, 21*d* and 21*e* which correspond to the embroidering machines 3, 4, 5 and 6, respectively.

Next, based on the embroidering machine data stored in the second data memory area 13*b* and the table TB, the registered names of the embroidering machines currently powered ON are retrieved (S12). The registered names are displayed in a name displaying area 21*f* of each of four areas 21*b*, 21*c*, 21*d* and 21*e* in a predetermined order, e.g., from the first to fourth embroidering machines, alphabetical order, or the like (S13). As for the embroidering machines to which names have not been registered, the ID numbers are displayed in the name displaying areas 21*f*.

In this embodiment, as shown in FIG. 3, names "TARO" and "KEN" are assigned to the first and second embroidering machines 3 and 4, respectively, but no names are assigned to the third and fourth embroidering machines 5 and 6. Therefore, as shown in FIG. 8, names "TARO" and "KEN" are displayed in the name display areas 21*f* corresponding to the first and second embroidering machines 3 and 4, and the ID numbers "SM3" and "SM4" are displayed in the name display areas 21*f* for the third and fourth embroidering machines 5 and 6, respectively.

Figure 6:
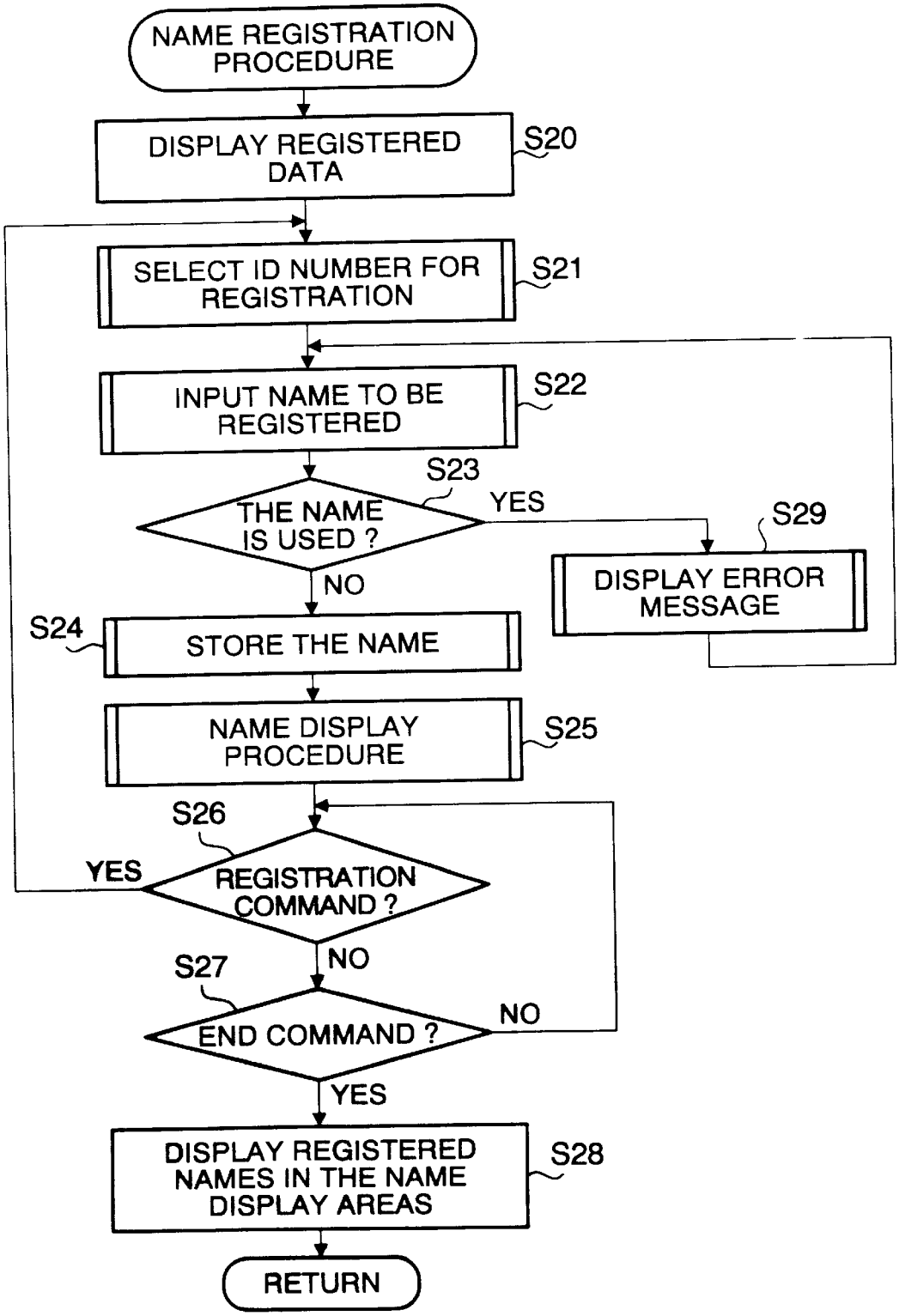
FIG. 6 shows a flowchart illustrating a NAME REGISTRATION PROCEDURE.

If the mouse 27 is operated and a REG. button 211 displayed in the common area 21*a* is clicked (i.e., a mouse pointer, not shown, is located on the REG. button 211 and a mouse button of the mouse 27 is clicked) when the divided areas 21*b*, 21*c*, 21*d* and 21*e* are displayed on the screen of the CRT display 21, a REGISTRATION command is input into the CPU 11 (S14:YES), and the NAME REGISTRATION PROCEDURE shown in FIG. 6 is executed (S15).

Figure 9:
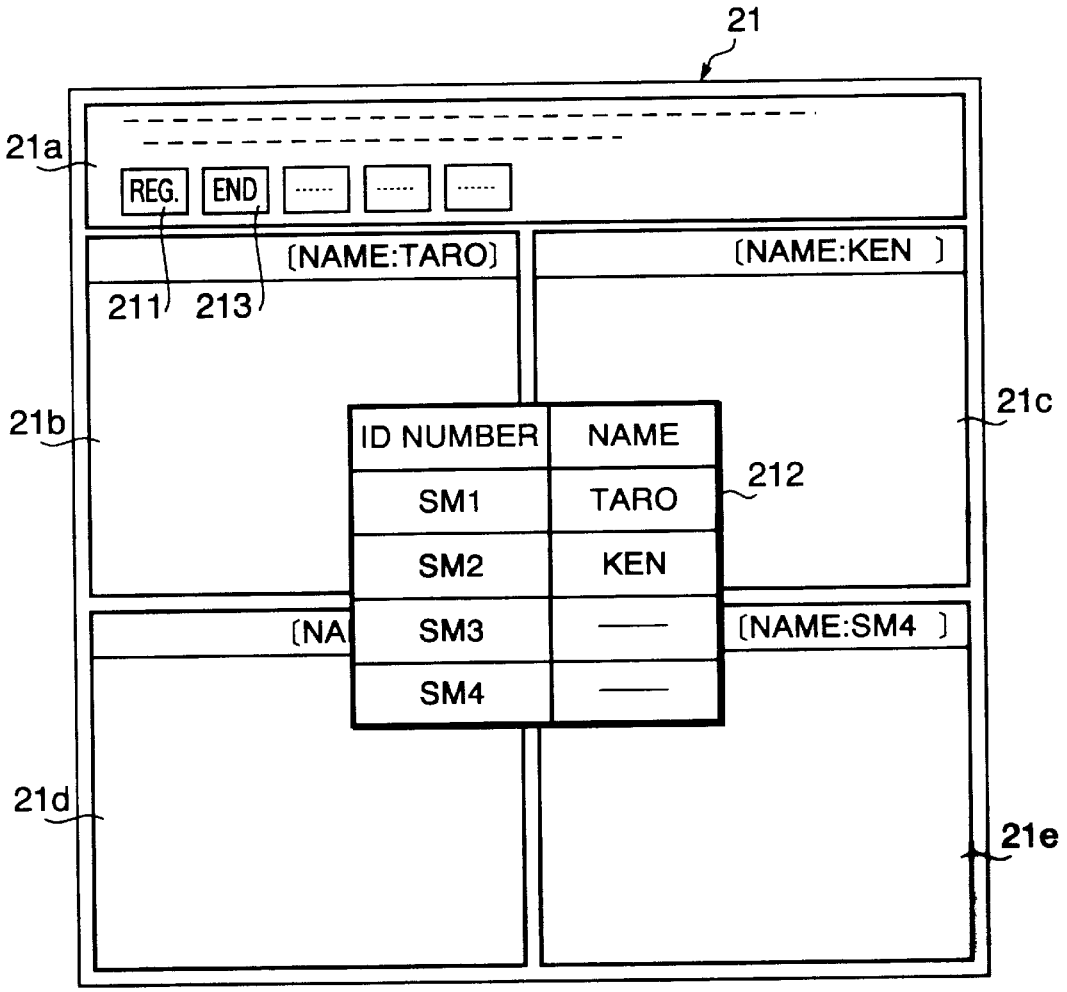
FIG. 9 shows the screen image similar to FIG. 8 when the NAME REGISTRATION PROCEDURE is executed.
Figure 10:
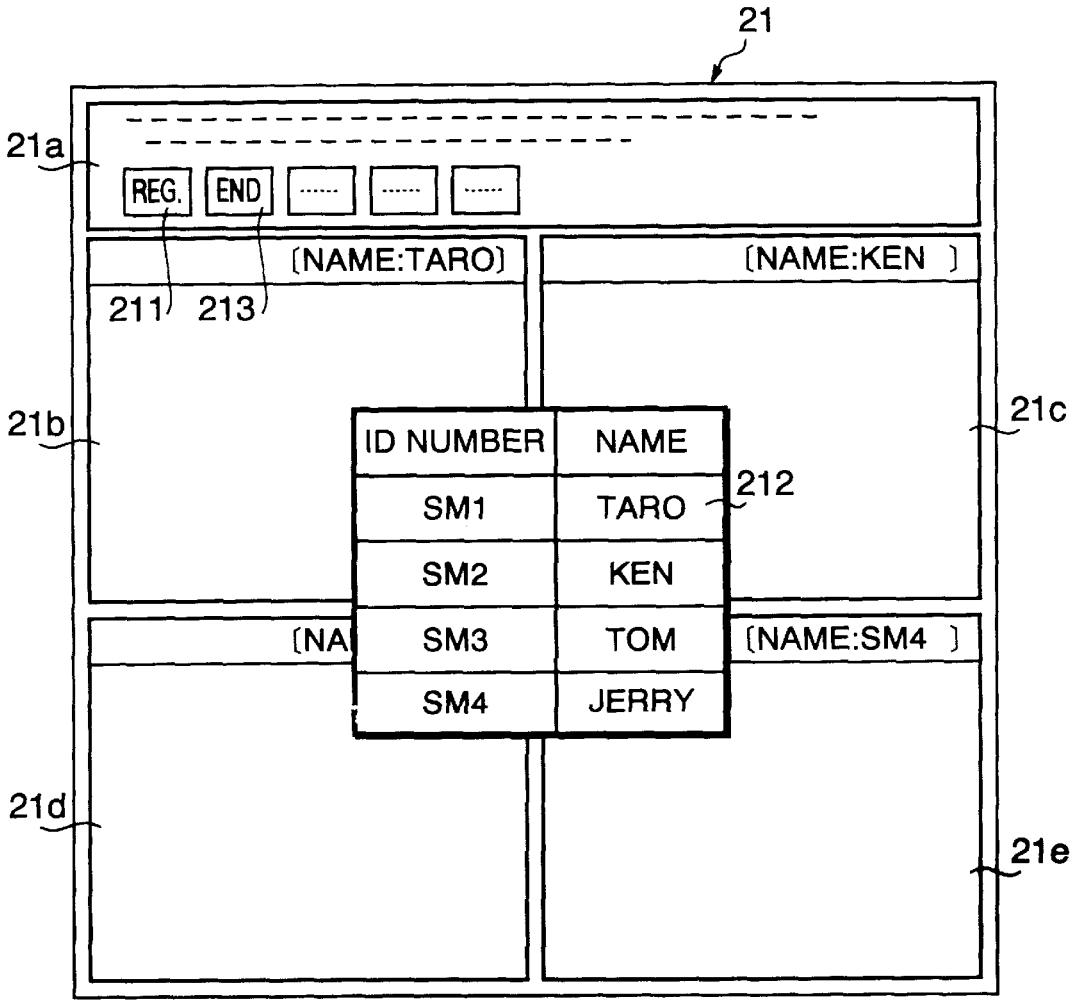
FIG. 10 shows the screen image similar to FIG. 9 when new names are registered.

In the NAME REGISTRATION PROCEDURE, firstly the embroidering machine data stored in the second data memory area 13*b* is retrieved and displayed (S20). FIG. 9 shows the screen image of the CRT display 21 in which the embroidering machine data is displayed in a table 212 which overlaps on the four areas 21*b*, 21*c*, 21*d* and 21*d*. When the operator selects one of the ID numbers indicated on the left-hand side cells in the displayed table 212 by locating the mouse pointer and clicking the mouse button of the mouse 27, it becomes possible to input or change the name for the selected ID number (S21). At this stage, the operator may input, through the keyboard 20, a new name for the embroidering machine corresponding to the selected ID number (S22). It is determined, at S23, whether the newly input name has already been assigned to another ID number. If the newly input name has already been assigned to another ID number (S23:YES), an error message is displayed on the screen of the CRT display 21 (S29) for a predetermined period of time, and then control returns to S22. If the newly input name has not been assigned to another ID number (S23:NO), the input name is stored, at S24, as the name corresponding to the selected ID number (i.e., the selected embroidering machine). At S25, the table 212 is redrawn on the screen of the CRT display 21. In this case, the table 212 includes the newly input name. If the operator intends to input another new name, the operator clicks the REG. button 211 with use of the mouse 27. Then, it is determined that the REG. button 211 is clicked (S26:YES), and control returns to S21 so that the operator can select another ID number at S21. Thereafter, the above-described procedure of S22 through S26 is repeated. If, for example, a name "TOM" is input for the ID number "SM3" and another name "JERRY" is input for the ID number "SM4", the table 212 is displayed as shown in FIG. 10.

If the REG. button 211 is not clicked after the table 212 is redrawn at S25, control repeatedly executes steps S26 and S27 until one of the REG. button 211 or an END button 213 is clicked.

If the END button 213 displayed in the common area 21*a* is clicked by the mouse 27 (S27:YES), the newly input names are displayed in the respective name displaying areas 21*f* (S28), and the NAME REGISTRATION PROCEDURE is terminated.

Figures 11, 12:
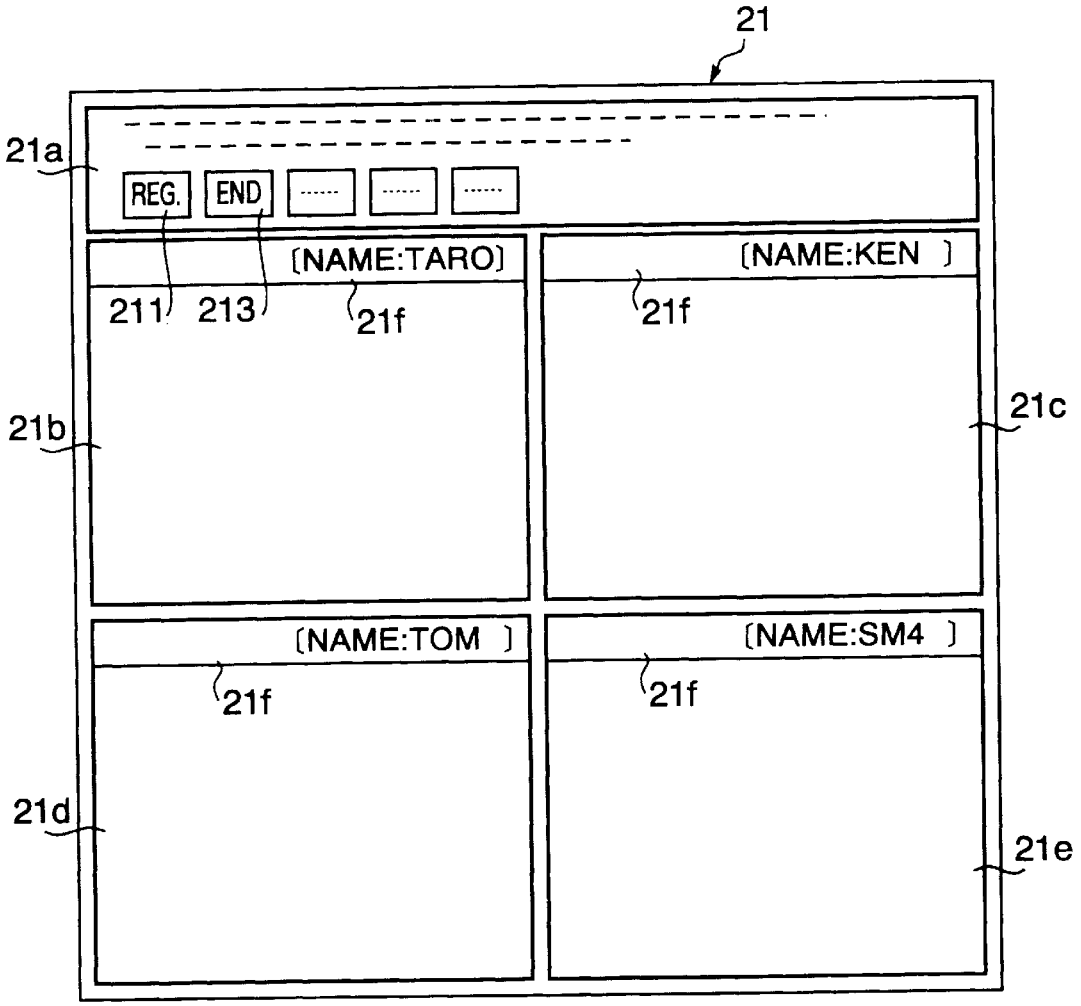
FIG. 11 shows the screen image similar to FIG. 8 except that newly registered names are displayed.
FIG. 12 is a table showing embroidering machine data stored in the second data memory area according to a second embodiment of the invention.

FIG. 11 shows an exemplary screen image displayed on the CRT display 21, in which the newly input names "TOM" and "JERRY" are displayed in the name displaying areas 21*f* corresponding to the embroidering machine ID numbers SM3 and SM4.

If the END button 213 is clicked by the mouse 27 when the image as shown in FIG. 11 is displayed on the CRT display 21, the CPU 11 determines that an END command is input (S16:YES), and the SEWING CONDITION DISPLAY PROCEDURE is terminated, and control returns to a not shown main procedure.

As described above, according to the first embodiment, desired names can be assigned to the embroidering machines, and the names are stored in relation to the corresponding ID numbers "SMn" in the second data memory area 13*b* of the RAM 13 which is provided in the host computer 10 of the personal computer 1. The names can be displayed on the CRT display 21. Accordingly, the operators can assign names which enable the operators to identify each embroidering machine easily, and refer to the name on the CRT display 21. Therefore, according to the first embodiment, it becomes possible to prevent the operators from erroneously identifying a wrong embroidering machine, which prevents inferior products from being produced and improves rate of operation of the embroidering system.

Next, with reference to FIGS. 12 through 16, an embroidering system 1M according to a second embodiment of the invention will be described. It should be noted that the schematic configuration of the embroidering system 1M is similar to the embroidering system 1 shown in FIG. 1, and therefore a reference numeral "1M" is also indicated in FIG. 1.

According to the second embodiment, instead of using names respectively intrinsic to the embroidering machines, colors are used for identifying the respective embroidering machines. In the embroidering system 1M according to the second embodiment, a color plate for identifying each embroidering machine is arranged at a easily recognizable position close to the corresponding embroidering machine, and the color is registered with the host controller 10 so that the colors intrinsic to a plurality of embroidering machines are displayed on the divided areas 21*b*, 21*c*, 21*d* and 21*e* of the CRT display 21.

A system configuration including the personal computer 2, the host controller 10, the embroidering machines 3, 4, 5 and 6, the control device 30 are substantially the same as those in the first embodiment, and therefore description thereof will be omitted. Portions different from the first embodiment will be described hereinafter.

In this embodiment, in the second data memory area 13*b* shown in FIG. 2, the ID numbers SM1, SM2, SM3 and SM4, which have been transmitted from the embroidering machines 3, 4, 5 and 6, respectively, and ID (identification) color data respectively corresponding to the embroidery machines 3, 4, 5 and 6 are stored. The ID color for each of embroidering machines 3, 4, 5 and 6 is registered in a COLOR REGISTRATION PROCEDURE which will be described in detail later.

Figure 13:
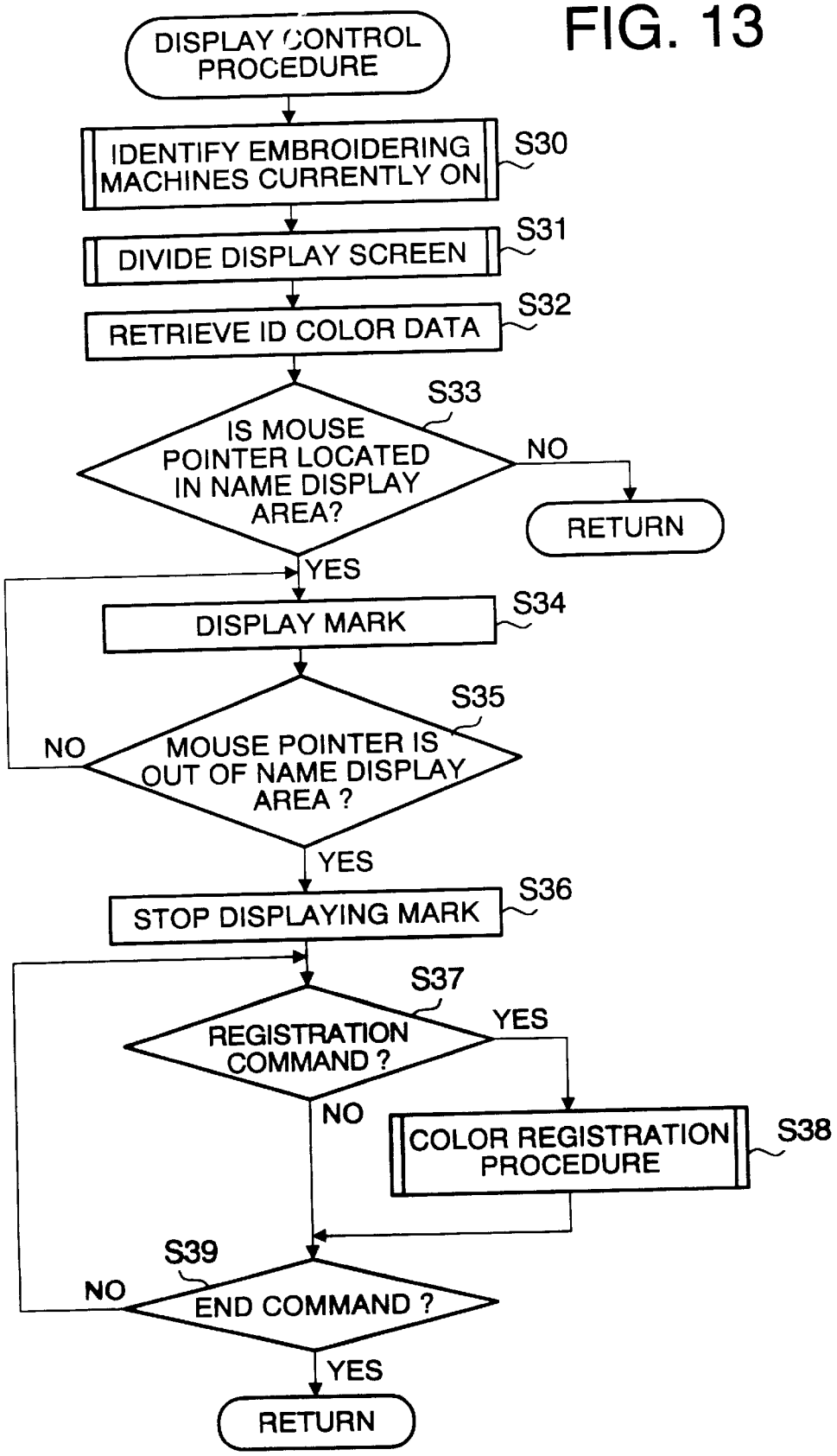
FIG. 13 shows a flowchart illustrating a DISPLAY CONTROL PROCEDURE according to the second embodiment of the invention.

FIG. 13 shows a flowchart illustrating a DISPLAY CONTROL PROCEDURE according to the second embodiment. The procedure is initiated when an operator inputs a sewing condition display command through the keyboard 20 of the personal computer 2.

At S30, the host controller 10 identifies the embroidering machines currently turned ON. Specifically, the host controller 10 transmits the sewing condition display command to each of the embroidering machines 3, 4, 5 and 6. Then, based on the ID numbers transmitted from the embroidering machines 3, 4, 5 and 6, the host controller 10 creates a table TB shown in FIG. 7 in a work area of the RAM 13. The table TB indicates whether each of the embroidering machines 3, 4, 5 and 6 is currently powered ON or OFF.

Then, at S31, the screen of the CRT display 21 is divided into a plurality of display areas, the number of the display areas being the number of the embroidering machines currently powered ON, and thus operative.

Figure 15:
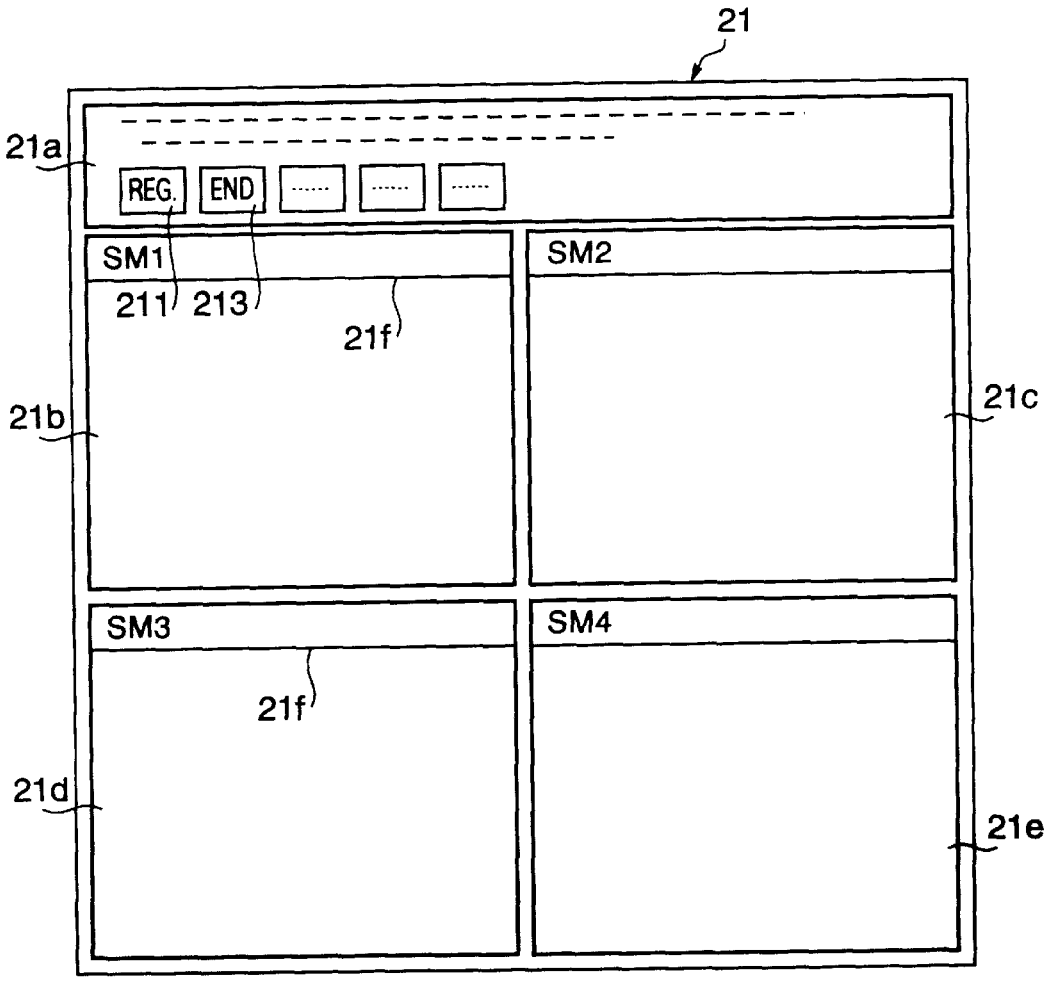
FIG. 15 shows a screen image divided into four areas.

If, for example, all of the embroidering machines 3, 4, 5 and 6 are powered ON, the display screen of the CRT display 13 is divided into one common area 21*a* and four areas 21*b*, 21*c*, 21*d* and 21*e* which correspond to the embroidering machines 3, 4, 5 and 6, respectively, as shown in FIG. 15. Each of the four areas 21*b*, 21*c*, 21*d* and 21*e*, the name displaying area 21*f* is provided In the second embodiment, the ID numbers "SM1", "SM2", "SM3" and "SM4" of the embroidering machines 3, 4, 5 and 6 are displayed in the name displaying areas 21*f* (see FIG. 15).

Next, the ID color data for the embroidering machines currently powered ON is retrieved from the second data memory area 13*b* (S32). At S33, it is determined whether the mouse pointer 21*m* is located within one of the name displaying areas 21*f*. If the mouse pointer 21*m* is not located within any name displaying areas 21*f* (S33:NO), the DISPLAY CONTROL PROCEDURE is terminated. If the mouse pointer 21*m* is located within one of the name displaying areas 21*f* (S33:YES), a mark 21*w* having a color assigned to the embroidering machine corresponding to the ID number displayed in the area 21*f*, at which the mouse pointer 21*m* is located, is displayed below the name displaying area 21*f*. In this embodiment, the mark includes the ID number, and a rectangular area having the ID color corresponding to the ID number.

Figure 16:
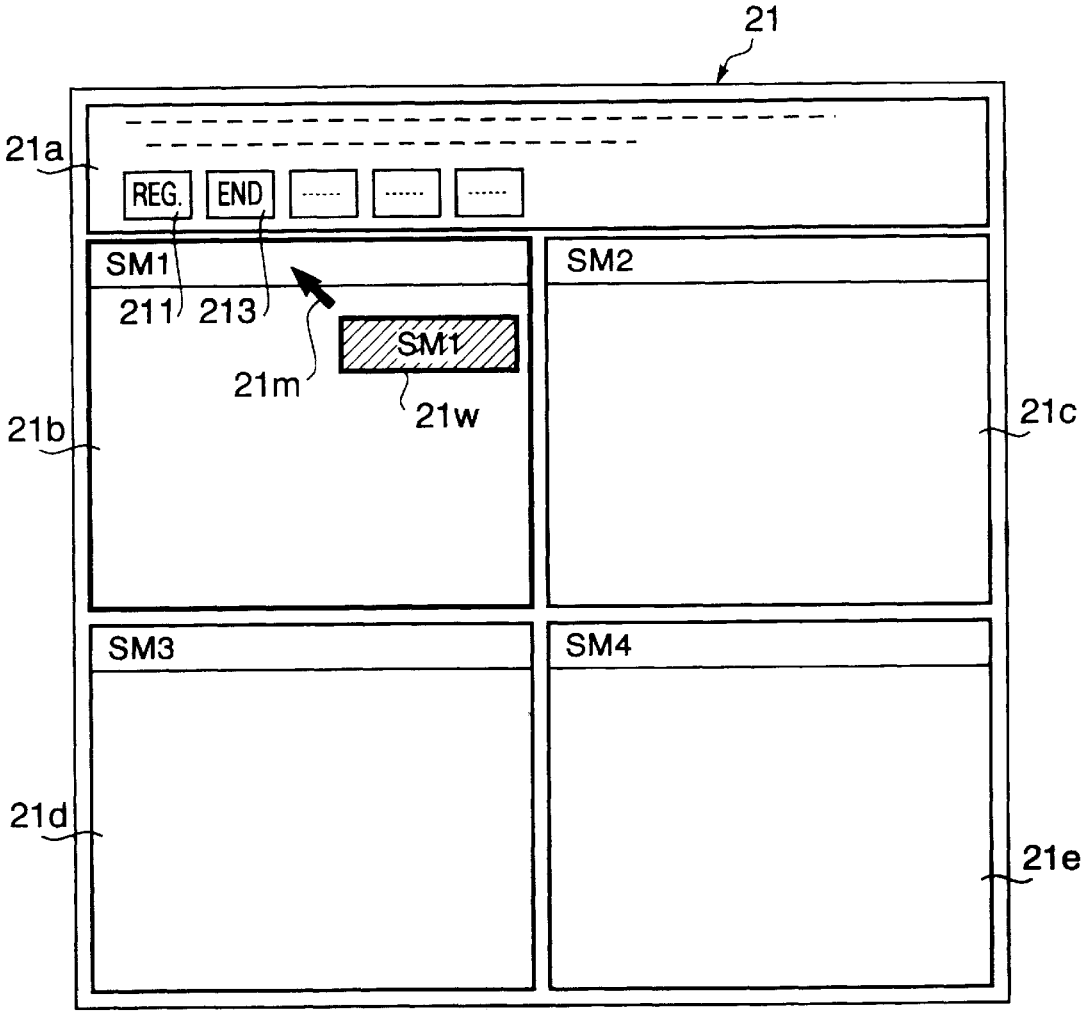
FIG. 16 shows an example of the screen image on which a colored mark is displayed.

For example, if red is assigned as an ID color to the embroidering machine 3, as shown in FIG. 12, and when the mouse pointer 21*m* is located on the name displaying area 21*f* for the embroidering machine 3 as shown in FIG. 16, the rectangular mark 21*w* is displayed below the name displaying area 21*f*, within the area 21*b*, in red. In the rectangular mark 21*w*, the ID number "SM1" is displayed. Thus, the operator can recognize the embroidering machine whose setting is currently referred to, based on the ID plate disposed at the embroidering machine 3 and the mark 21*w* shown on the CRT display 21.

At S35, it is determined whether the mouse pointer 21*m* has been moved out of the name displaying area 21*f*. If the mouse pointer 21*m* stays on the name displaying area 21*f* (S35:NO), the mark 21*w* remains displayed and step S34 is repeatedly executed. If the mouse pointer 21*m* has been moved out of the name displaying area 21*f* (S35:YES), the mark 21*m* disappears (S36).

Figure 14:
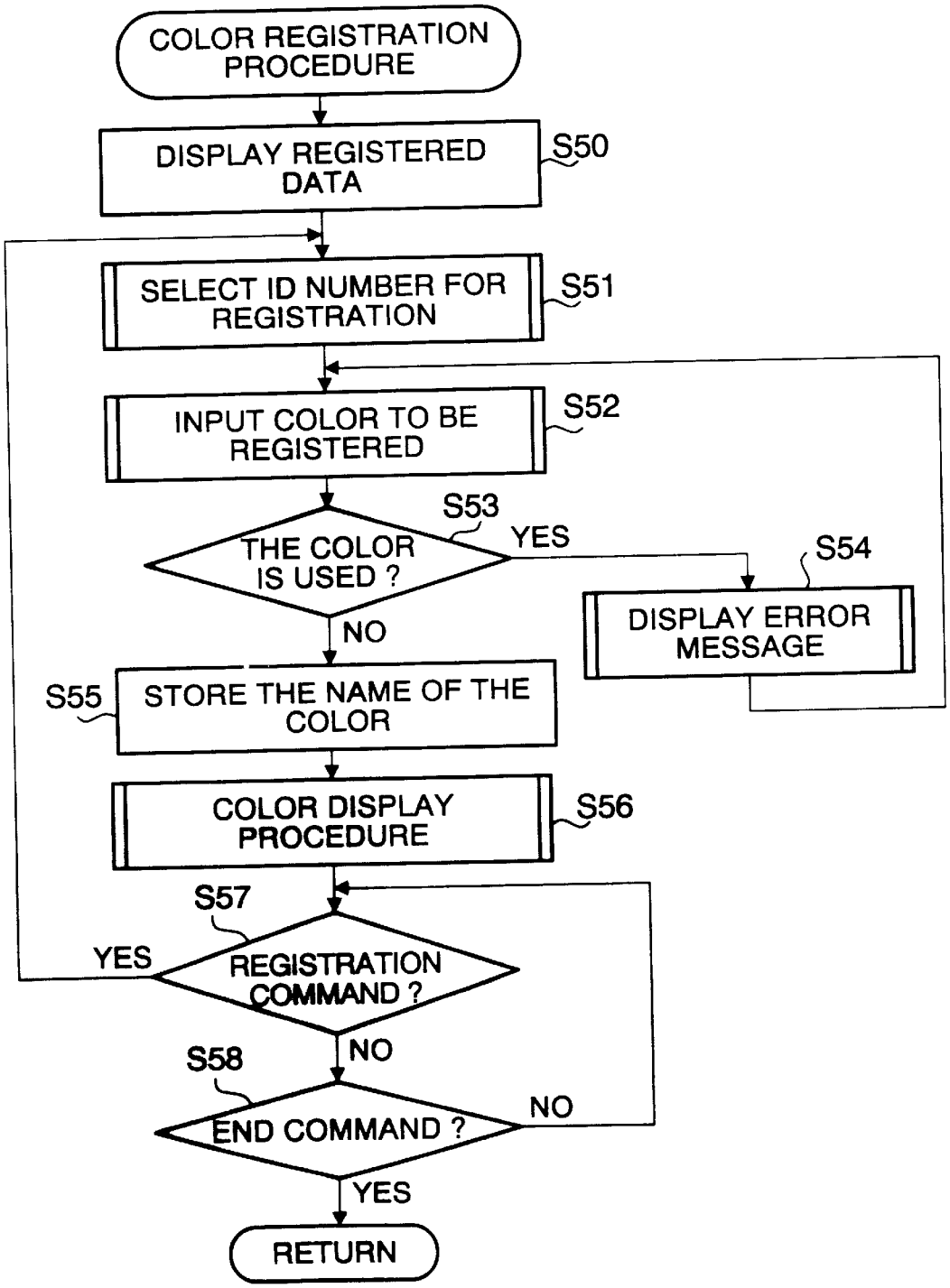
FIG. 14 shows a flowchart illustrating a COLOR REGISTRATION PROCEDURE.

If the mouse 27 is operated and a REG. button 211 displayed in the common area 21*a* is clicked by the mouse 27, when the divided areas 21*b*, 21*c*, 21*d* and 21*e* are displayed on the screen of the CRT display 21, a REGISTRATION command is input into the CPU 11 (S37:YES), and the COLOR REGISTRATION PROCEDURE shown in FIG. 14 is executed (S38).

Figure 17:
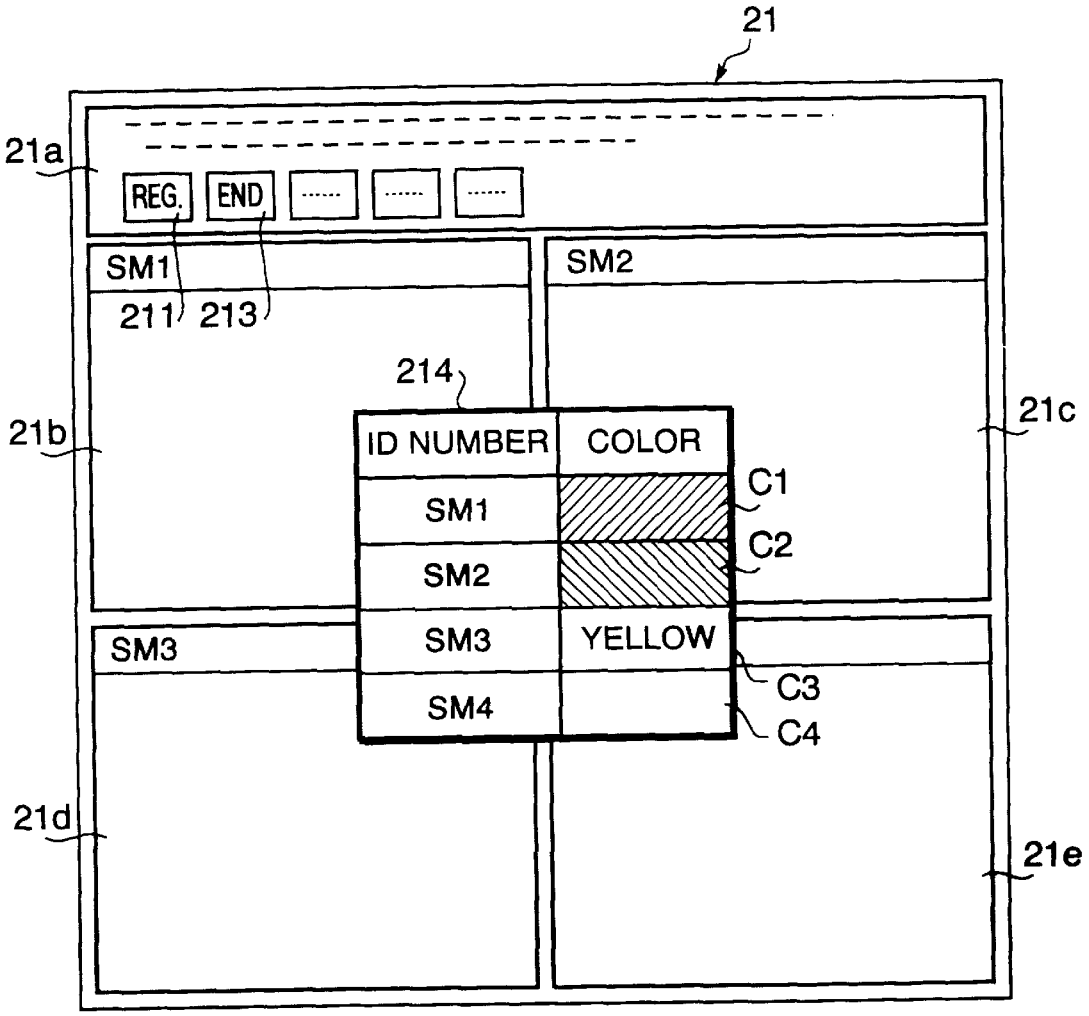
FIG. 17 is the screen image displayed on the CRT display when the COLOR REGISTRATION PROCEDURE is executed.

In the COLOR REGISTRATION PROCEDURE, firstly the embroidering machine data stored in the second data memory area 13*b* is retrieved and displayed (S50). FIG. 17 shows the screen image of the CRT display 21 in which the embroidering machine data is displayed in a table 214 which overlaps on the four areas 21*b*, 21*c*, 21*d* and 21*e*. In this example, to the embroidering machines 3 and 4, the ID colors have been assigned, and accordingly, the ID numbers are indicated on the left-hand side cells of the table 214, and on the right-hand side cells C1 and C2 corresponding to the ID numbers "SM1" and "SM2", the colors assigned thereto are indicated (i.e., the cells are filled with the colors).

When the operator selects one of the ID numbers indicated on the left-hand side cells in the displayed table 214 by clicking the mouse pointer 21*m* thereon, it becomes possible to input a name of a color for the selected ID number (S51). For example, if the operator selects the ID number "SM3" by clicking the ID number "SM3", the operator can input the name of the color to be assigned to the ID number "SM3" through the keyboard 20 (S52). In the example shown in FIG. 17, letters "YELLOW" has been input in cell C3. It is determined, at S53, whether the newly input color name corresponds to a color which has already been assigned to another ID number. If the newly input color name corresponds to the color which has already been assigned to another ID number (S53:YES), an error message is displayed on the screen of the CRT display 21 (S54) for a predetermined period of time, and then control returns to S52. If the newly input color name corresponds to a color which has not yet been assigned to the other ID numbers (S53:NO), the input color name is stored in the second data memory area 13*b*, at S55, as the color name corresponding to the selected ID number (i.e., the selected embroidering machine). At S56, the table 214 is redrawn on the screen of the CRT display 21 to show the change. In this case, the letters "YELLOW" in cell C3 are deleted, and cell C3 is displayed in yellow. If the operator intends to assign another color to any one of the embroidering machines 3, 4, 5 and 6, the operator clicks the REG. button 211 with use of the mouse 27. Then, it is determined that the REG. button is clicked (S57:YES), and control returns to S51 so that the operator can select another ID number at S51. Thereafter, the above-described procedure of S51 through S57 is repeated. It should be noted that, in table 214, since no color is assigned to the ID number "SM4", cell C4 is indicated as a blank cell (no color or letters are indicated).

If, after the table 214 is redrawn, the REG. button 211 is not clicked (S57:NO) and an END button 213 displayed in the common area 21*a* is clicked by the mouse pointer 21*m* (S58:YES), the COLOR REGISTRATION PROCEDURE is terminated.

As described above, according to the second embodiment, desired colors can be assigned to the embroidering machines, and the colors are stored in relation to the corresponding ID numbers "SMn" in the second data memory area 13*b* of the RAM 13 which is provided in the host controller 10 of the personal computer 2. The colors can be displayed on the CRT display 21. Accordingly, the operators can assign colors which enable the operators to identify each embroidering machine easily. Further, the color plates are disposed at the embroidering machines. Accordingly, the operators can identify a subjected embroidering machine when operating the embroidering system simply by comparing the colors displayed on the CRT display and the color plates at the embroidering machines. Therefore, according to the second embodiment, it becomes possible to prevent the operators from erroneously identifying a wrong embroidering machine, which prevents inferior products from being produced and improves rate of operation of the embroidering system. It should be noted that the rectangular mark 21*w* is displayed only when the mouse pointer 21*m* is located in the name displaying area 21*f*, and therefore, the mark 21*w* can be removed from the screen of the CRT display 21 and may not interfere the operation of the operators.

Further, it is possible to display a table indicating the relationship between the ID numbers and the ID colors, and the ID colors can be registered or changed easily. The ID colors can be input as the names of the colors through the keyboard.

In the second embodiment, the mark 21*w* is displayed only when the mouse pointer 21*m* is located within the name displaying areas 21*f*. It can be modified such that the mark 21*w* is displayed for a predetermined period of time (e.g., 5 seconds), and then disappears regardless whether the mouse pointer is within the ID number displaying areas 21*f*.

Alternatively or optionally, an outer frame of each of the areas 21*b*, 21*c*, 21*d* and 21*e* is displayed to have its ID color. Further, the name display area 21*f* may have the ID color as a background color.

As for the embroidering machines, instead of the ID color plates, lamps having respective ID colors may be placed adjacent to the embroidering machines. Alternatively or optionally, at least a part of the embroidering machines may be pained with respective ID colors.

In the first and second embodiments, the personal computer may be replaced with various types of computers, and/or the embroidering machines may be controlled by a plurality of host controllers interconnected through a net work system. Further, the embroidering machines may be replaced with general-use sewing machines.

Further, the ID number of the embroidering machine is not limited to a number based on a predetermined numbering system, but an arbitrarily determined string of alphanumerical characters, symbols or the like can be used as a number as far as it is intrinsic to each embroidering machine.

The invention may be embodied in other specific forms without departing from the spirit of essential characteristics thereof. The present embodiments are therefore to be considered in all respect as illustrative and not restrictive, the scope of the invention being indicated by the appended claims rather than by the foregoing description and all changes which come within the meaning and range of equivalency of the claims are therefore intended to be embraced therein.

In the above description, the first and second embodiments are described as separate embodiments. It should be noted that the first and second embodiments can be combined so that the operators can identify each embroidering machine at least by the name or color.

The present disclosure relates to subject matters contained in Japanese Patent Applications No. HEI 09-95091, filed on Mar. 28, 1997, and No. HEI 09-279948, filed on Sep. 25, 1997, which are expressly incorporated herein by reference in their entireties.

What is claimed is:

1. A sewing system including a plurality of sewing machines and a controlling device which is electrically connected with said plurality of sewing machines for transmitting control commands to said plurality of sewing machines, said controlling device including:

a memory device which stores identification data for identifying each of said plurality of sewing machines;

a data registering device, which is used for registering arbitrarily registered data in relation to said identification data stored in said memory device for identifying each of said plurality of sewing machines; and a displaying device having a display screen, wherein said controlling device displays said arbitrarily registered data on said display screen for identifying each of said plurality of sewing machines, and wherein said control commands are transmitted to sewing machines identified by said arbitrarily registered data displayed by said displaying device.

2. The sewing system according to claim 1, wherein said memory device stores said arbitrarily registered data.

3. The sewing system according to claim 2, wherein said identification data for identifying each of said plurality of sewing machines is transmitted from each of said plurality of sewing machines, and stored in said memory device.

4. The sewing system according to claim 1, wherein said data registering device comprises a data input device through which said arbitrarily registered data is input.

5. The sewing system according to claim 1, wherein said arbitrarily registered data includes names of said plurality of sewing machines, said names being intrinsic to said plurality of sewing machines, respectively.

6. The sewing system according to claim 1, wherein said arbitrarily registered data includes colors of said plurality of sewing machines, said colors being intrinsic to said plurality of sewing machines, respectively.

7. The sewing system according to claim 2, wherein said data registering device comprises:

a display controller which displays said identification data, and said arbitrarily registered data in relation to said identification data; and a data inputting device, which is manually operated to input data to be registered as said arbitrarily registered data, said data input by said data inputting device being stored in said memory device, a relationship between said identification data and said arbitrarily registered data being maintained in said memory device.

8. The sewing system according to claim 7, wherein said data inputting device is used for registering new data.

9. The sewing system according to claim 7, wherein said data inputting device is used for changing said arbitrarily registered data.

10. The sewing system according to claim 1, wherein said controlling device comprises an operation condition detecting device, which detects an operation condition of each of said plurality of sewing machines, and wherein said controlling device defines a plurality of displaying areas on said display screen, a total number of said plurality of displaying areas being equal to a total number of said plurality of sewing machines which are detected, by said operation condition detecting device, to be operative.

11. The sewing system according to claim 10, wherein said controlling device assigns each of said plurality of sewing machines to each of said plurality of displaying areas according to a predetermined order, said displaying areas respectively having arbitrarily registered data displaying areas, said arbitrarily registered data being displayed in said arbitrarily registered data displaying areas, respectively.

12. The sewing system according to claim 11, wherein said identification data is displayed in said arbitrarily registered data displaying areas for sewing machines to which said arbitrarily registered data has not registered.

13. The sewing system according to claim 11, wherein said arbitrarily registered data includes names intrinsic to said plurality of sewing machines.

14. The sewing system according to claim 11, wherein said arbitrarily registered data includes colors intrinsic to said plurality of sewing machines.

15. The sewing system according to claim 14, wherein said colors intrinsic to said plurality of sewing machines are displayed in said plurality of displaying areas, respectively.

16. The sewing system according to claim 15, wherein each of said colors intrinsic to said plurality of sewing machines is displayed in a predetermined mark having each of said colors.

17. The sewing system according to claim 16, wherein said mark includes said identification data.

18. The sewing system according to claim 16, wherein said controlling device further comprises a mouse pointer for pointing to an arbitrary point on said display screen, and for controlling said displaying device to display said mark when a predetermined area of said plurality of displaying areas is indicated by said mouse pointer.

19. A memory medium which stores a program executed by a controller of a sewing system, said sewing system including a plurality of sewing machines electrically connected to said controller, said program including steps of:

storing identification data for identifying each of said plurality of sewing machines in a memory device;

registering arbitrarily registered data in relation to said identification data stored in said memory device for identifying each of said plurality of sewing machines;

displaying said arbitrarily registered data on a display screen for identifying each of said plurality of sewing machines; and transmitting control commands to sewing machines identified by said arbitrarily registered data displayed at said displaying step.

20. The memory medium according to claim 19, wherein said program further including a step of detecting an operation condition of each of said plurality of sewing machines, and wherein said displaying step includes a step of defining a plurality of displaying areas on said display screen, a total number of said plurality of displaying areas being equal to a total number of said plurality of sewing machines which are detected, at said detecting step, to be operative.

* * * * *